United States Patent [19]

Webb

[11] Patent Number: 4,642,955

[45] Date of Patent: Feb. 17, 1987

[54] MOLDED WINDOW ASSEMBLY AND TRANSOM SUPPORT THEREFOR

[75] Inventor: Dale P. Webb, Conneaut, Ohio

[73] Assignee: Webb Manufacturing, Inc., Conneaut, Ohio

[21] Appl. No.: 845,846

[22] Filed: Mar. 28, 1986

[51] Int. Cl.[4] ..... E06B 1/04

[52] U.S. Cl. ..... 52/204; 52/208; 49/504; 49/DIG. 2

[58] Field of Search ..... 52/204–215; 49/504, DIG. 2

[56] References Cited

U.S. PATENT DOCUMENTS

| | | | |
|---|---|---|---|
| 3,703,063 | 11/1972 | Budich et al. | 52/204 X |
| 4,237,665 | 12/1980 | Molyneux | 52/204 X |
| 4,563,846 | 1/1986 | Webb | 52/208 |

*Primary Examiner*—J. Karl Bell

*Attorney, Agent, or Firm*—Renner, Otto, Boissell & Lyon

[57] ABSTRACT

Molded window assembly includes a window frame having a generally flat bottom wall to which a transom stiffener is attached, and a sill extending downwardly from the front edge of the bottom wall in front of the stiffener. End blocks are telescopically received in opposite ends of the stiffener to take up any clearance space between the ends of the stiffener and the adjacent sides of spaced apart wall studs in an opening in an exterior wall in which the window assembly is mounted above a window or patio door unit therebelow. Universal nailing plates at the outer ends of the end blocks facilitate attachment of the ends of the stiffener to the sides of the wall studs for transferring the weight of the window assembly to the wall studs. Also, universal corner plates have one end inserted between the nailing plates and adjacent side of the wall studs for attachment thereto, and the other end extends at right angles thereto and is secured to the back edge of the wall studs to transfer the shear or torque loads caused by the window assembly to the wall studs.

27 Claims, 5 Drawing Figures

MOLDED WINDOW ASSEMBLY AND TRANSOM SUPPORT THEREFOR

BACKGROUND OF THE INVENTION

This invention relates generally, as indicated, to a molded window assembly, and more particularly to a decorative molded half-round window assembly intended to be installed over a rectangular window or patio door unit to add a customized appearance, and to a transom support for supporting such window assembly above such window or patio door unit.

It is generally known from U.S. Pat. No. 4,563,846, assigned to the same assignee as the present application, to provide a molded architectural window assembly in which the sash, sill, frame and exterior trim are all integrally molded as a unit out of a suitable plastic material such as urethane formed by a Reaction Injection Molded (RIM) process. Such a window assembly has the advantage that it can readily be molded in a variety of shapes and sizes, has good insulating properties, and is relatively easy to install. Another important advantage is that the exterior surfaces of such a window assembly may be coated with a long-lasting finish that eliminates the need for painting and will retain an attractive appearance for many years. Also, wooden interior trim parts may readily be fastened to the interior side of the window assembly to match the other interior woodwork.

In the usual case, no special materials are required to install such window assemblies. However, because urethane does not have a very high tensile strength, heretofore when a larger window assembly of this type was installed over a window or patio door unit, it was necessary to provide a relatively large, heavy header above the window or patio door unit to prevent the window assembly from sagging and interfering with the operation of the window or patio door unit therebeneath. This had the disadvantage that more space than was desired had to be provided between the window assembly and window or door unit thèrebeneath to accomodate the header, which adversely affected the overall appearance of the installation.

SUMMARY OF THE INVENTION

With the foregoing in mind, it is the principal object of this invention to provide a novel molded window assembly and transom support therefor that permits the spacing between the window assembly and window or patio door unit therebeneath to be minimized so that the window assembly has the appearance of being an integral part of the window or patio door unit.

In accordance with one aspect of the invention, the bottom wall of the window assembly is substantially flat and has box-like transom stiffener extending substantially the entire length thereof, such stiffener being substantially covered from the front by the exterior window sill which extends downwardly below the front edge of such bottom wall.

In accordance with another aspect of the invention, the transom stiffener has a width greater than the bottom wall of the window assembly, whereby the transom stiffener extends inwardly beyond the interior face of the molded window frame to provide a top mounting surface for a wooden sash extending around the interior periphery of the window glass.

Further in accordance with the invention, an interiorly extending flange is desirably provided along the bottom edge of the rear wall of the transom stiffener, with nail holes through the flange to facilitate to attachment of the stiffener to the window or door unit therebeneath.

In accordance with another aspect of the invention, the rear wall of the transom stiffener may have provision for snap attachment of an interior trim piece thereto which also covers the interior stiffener flange.

Further in accordance with the invention, the transom stiffener is desirably hollow throughout its length, and has weep holes in the top wall adjacent the interior side of the window glass and also along the bottom front to provide for the escape of any moisture running down the interior surface of the glass.

Further in accordance with the invention, telescoping end blocks in the ends of the transom stiffener provide for the take-up of any gaps between the stiffener ends and the adjacent sides of wall studs within a rough opening in the exterior wall of the building in which the window assembly is mounted.

In accordance with another aspect of the invention, universal nailing plates at the outer ends of the end blocks facilitate attachment of the transom stiffener to the adjacent sides of the wall studs for transferring the weight of the window assembly supported thereby to the wall studs rather than to the window or door unit therebelow. Such a transom stiffener provides the necessary support for the window assembly during Uniform Building Code wind pressure at the thirty foot level creating seven hundred and fifty pounds of pressure to the window assembly.

In accordance with still another aspect of the invention, universal corner plates connected to the nailing plates and back edges of the wall studs transfer shear or torque loads created by the window assembly to the wall studs.

To the accomplishment of the foregoing and related ends, the invention, then, comprises the features hereinafter fully described and particularly pointed out in the claims, the following description and annexed drawings setting forth in detail a certain illustrative embodiment of the invention, this being indicative, however, of but one of the various ways in which the principles of the invention may be employed.

DESCRIPTION OF THE PREFERRED EMBODIMENT

Figure 1:
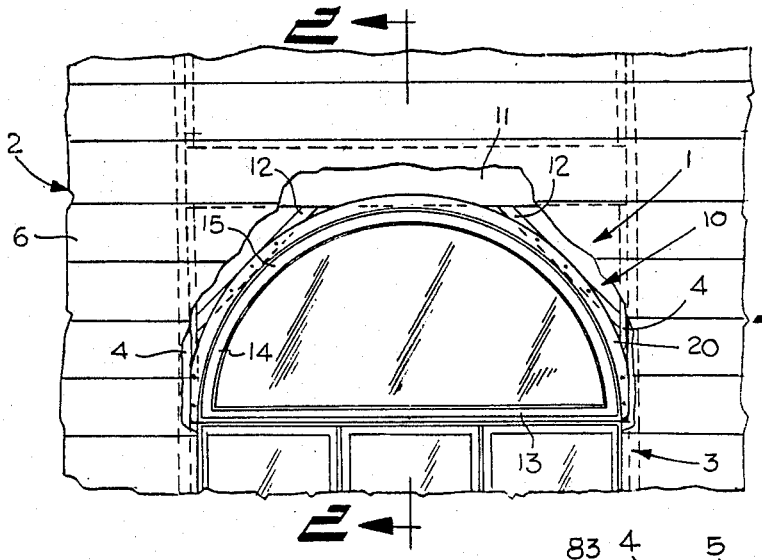
FIG. 1 is an exterior elevation view, partly cut away, of a preferred form of window assembly and transom support in accordance with this invention installed in an exterior wall over a window or patio door unit therebeneath.
Figure 2:
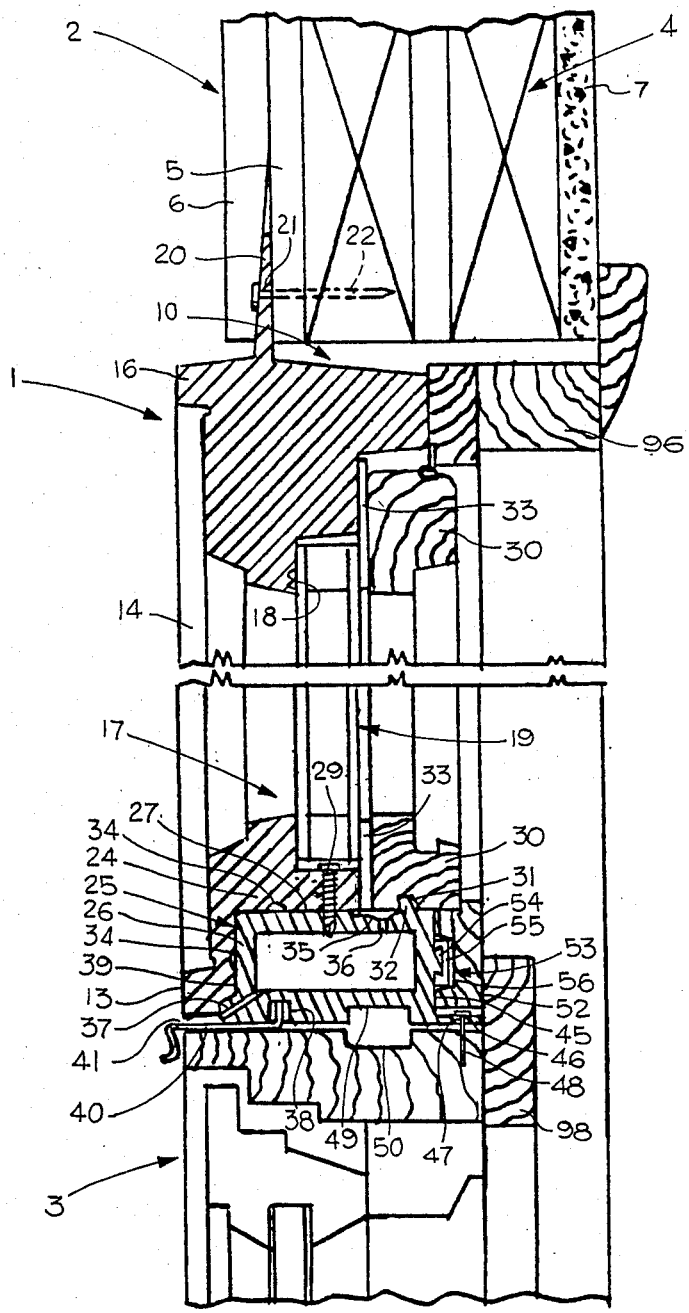
FIG. 2 is an enlarged fragmentary vertical section through the window assembly and transom support and wall of FIG. 1, taken generally along the plane of the line 2—2 thereof.

Referring now in detail to the drawings, and initially to FIGS. 1 and 2, there is shown a preferred form of window assembly 1 in accordance with this invention installed in the exterior wall 2 of a building over a window or patio door unit 3 to add a customized appearance. The exterior wall 2 may be of conventional type including the usual studwall 4 with sheathing 5 over the studwall and siding 6 of any suitable type over the sheathing to form the exterior surface. The interior finish wall 7 may be lath and plaster, wall board, paneling or any other conventional building material.

The window assembly 1 is desirably a half-round window assembly as shown, and is intended to be installed in a rough opening 10 in the wall 2 which is cut slightly larger than the frame portion 15 of the window assembly, such opening being defined by vertical studs 4 as well as cross members 11 and diagonal members 12. Since the window assembly is installed in a wall of a building structure, the terms interior, exterior, vertical and horizontal all relate to the usual and ordinary installation of any window in a generally vertical wall.

The sill 13, sash 14, frame 15 and exterior trim 16 of the window assembly 1 all preferably consist of a unitary structure formed for example of Reaction Injection Molded (RIM) urethane to provide a hard, smooth skin over a less dense and softer core. After molding, the exterior surfaces may be coated with a long-lasting finish that eliminates the need for painting after installation and will retain an attractive appearance for many years.

The sash portion 14 of the window assembly surrounds a window opening 17 bounded by a radially inner perimeter surface 18 which faces axially inwardly toward the interior for positioning the window glass 19 thereagainst. Additionally, the window assembly desirably includes a nailing flange 20 extending radially outwardly around the upper half-round portion of the window assembly which is used to position the window assembly in the rough opening 10 and to seal the installed window assembly. The nailing flange 20 is desirably integrally molded with the window assembly and may extend radially outwardly about $1\frac{3}{4}$ to $2\frac{1}{4}$ inches from the radial outermost surface of the frame portion 15 of the window assembly. A plurality of preformed holes 21 may be provided in the flange 20 to facilitate the driving of screws or nails 22 through the flange and into the underlying sheathing 5 and studs 4 to secure the window assembly in place.

Because the tensile strength of urethane is not very high, a larger molded window assembly of the type described will normally require additional support along the bottom wall 24 of the frame 15 to withstand hurricane wind forces on the glass 19 and to support the weight of the window assembly so that it is not transferred to the window or patio door unit 3 therebeneath to cause the same to sag and interfere with its operation. This is accomplished in accordance with the present invention by providing a transom support 25 for the window assembly which transfers the weight of the window assembly to the wall studs 4 rather than to the window or patio door therebeneath as described hereafter.

Figure 4:
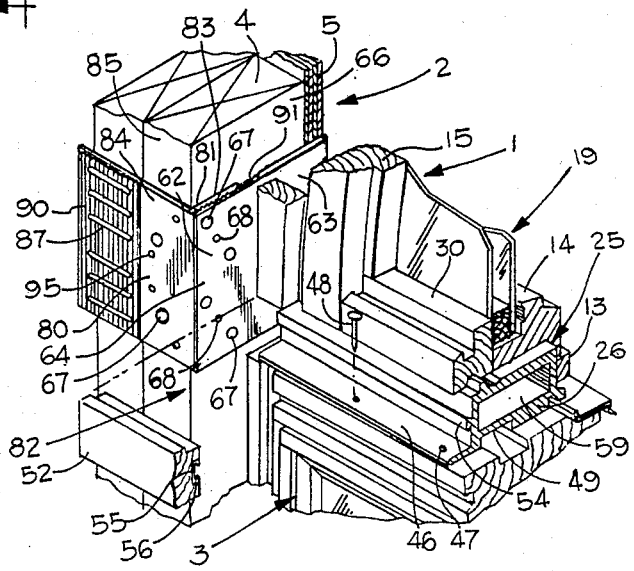
FIG. 4 is a fragmentary perspective view of the left rear end of the window assembly showing the manner in which the universal nailing plate and corner plate are fastened to a studwall made up of 2×4's to transfer loads to such wall studs.
Figure 3:
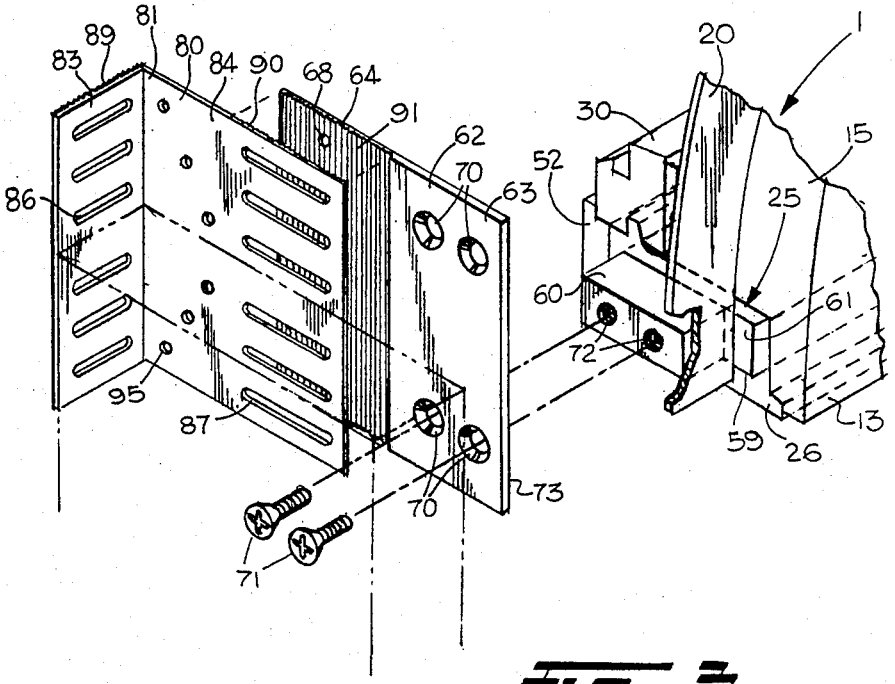
FIG. 3 is an enlarged partially exploded perspective view of the left front end of the window assembly and transom support showing the universal nailing plate and corner plate in disassembled relation.

As clearly shown in FIGS. 2–4, such transom support 25 includes a transom stiffener 26 adapted to be received in a groove 27 extending the full length of the bottom wall 24 of the window assembly. The groove 27 is closed along the front by the window sill 13 and sash 14, but is open along the back and bottom. The transom stiffener 26 itself is generally rectangular in cross-section and has a vertical height generally corresponding to the vertical height of the groove 27 whereby when the stiffener is inserted within the groove, its bottom wall will be generally flush with but desirably extends a slight distance below the bottom edge of the window sill. However, the stiffener 26 has a horizontal width somewhat greater than the horizontal width of the groove 27 (bottom wall 24) so that the stiffener extends inwardly beyond the interior of the window assembly for a purpose to be subsequently described. Preferably the stiffener is made of a relatively light weight metal such as 6061 T-6 aluminum which may be extruded into the desired generally hollow box-like shape.

The transom stiffener 26 is desirably permanently attached to the bottom wall 24 of the window assembly 1 at the factory as by drilling holes through the bottom wall along the bottom edge of the glass opening 17 and into the stiffener and inserting self-tapping screws 29 therein before installing the window glass 19 in place. Also, a suitable adhesive may be applied between the stiffener and window frame in a pair of shallow recesses 34 extending the full length of the window assembly, one such recess being in the bottom wall 24 and the other in the back wall of the sill. Afterwards, the glass may be installed using suitable setting blocks and glass clips or the like. Also, caulking strips or the like may be applied to the inner perimeter surface 18 surrounding the glass opening 17 to provide a fluid-tight joint therebetween.

After the glass has been installed, a wooden sash/stop 30 may be applied around the interior perimeter of the glass to cover the surrounding gap. As best seen in FIG. 2, the wood sash/stop 30 may be hingedly connected along the bottom to the top of the stiffener 26 interiorly of the glass 19 as by providing a groove or channel 31 in the sash/stop bottom that fits over a vertical rib 32 extending along the length of the stiffener top inwardly spaced from the glass. The wood sash/stop 30 may be removably held in place as by means of a foam tape 33 having adhesive on both sides placed between the window frame 15 and sash/stop 30 around the inner periphery of the glass and by the tubular weatherstrip which fits into a groove lip in the sash/stop.

A shallow channel or groove 35 is also desirably provided in the top of the stiffener 26 between the glass interior and vertical rib 32 to collect any moisture that may run down the interior face of the glass for discharge first into the interior of the stiffener 26 through longitudinally spaced weep holes 36 in the stiffener top and then through additional weep holes 37 along the bottom front of the stiffener leading to the exterior through a narrow gap 41 immediately beneath the sill 13. Also, a narrow longitudinal groove 38 may be provided in the bottom wall of the stiffener slightly inwardly spaced from the front wall 39 along the entire length thereof for receipt of a drip cap/jointing 40 which extends forwardly through the gap 41 out to the exterior to prevent any moisture from seeping interiorly of the groove 38.

Extending inwardly from the back wall 45 of the stiffener 26 along the bottom edge thereof is a nailing flange 46 having spaced apart holes 47 along the length thereof to facilitate attachment of the stiffener to the window or patio door unit 3 therebelow using nails or screws 48 or the like. Also, a relatively wide slot 49 may be provided in the bottom wall of the stiffener in vertical alignment with a slot 50 in the top of the unit 3 therebelow for receipt of a joiner device (not shown) if provided.

A trim piece 52 may be used to cover the back wall 45 of the stiffener and top surface of the nailing flange 46. Since the trim piece 52 must be removed during fastening of the nailing flange to the unit 3 therebelow, a snap connection 53 is desirably provided between the trim piece and back wall 45, formed as by providing a flanged projection 54 on the back wall that is adapted to be snapped into an extruded plastic clip 55 securely mounted within a longitudinal groove 56 in the adjacent surface of the trim piece.

Slidably received in the opposite ends 59 of the stiffener 26 are end blocks 60 (see FIG. 3) which may be moved in or out to a limited extent to provide for the direct attachment of the end blocks to the wall studs 4 as described hereafter. The end blocks 60 are desirably notched at 61 along the forwardly facing side adjacent the outer end thereof so that when the end blocks are inserted in the ends of the stiffener and the stiffener is attached to the bottom wall of the window assembly 1 as shown in FIG. 3, a portion of the nailing flange 20 or other surface on the window assembly will extend into the respective notches to prevent the end blocks from falling out of the stiffener ends while still permitting some relative sliding movement of the end blocks into and out of the stiffener ends.

Figure 5:
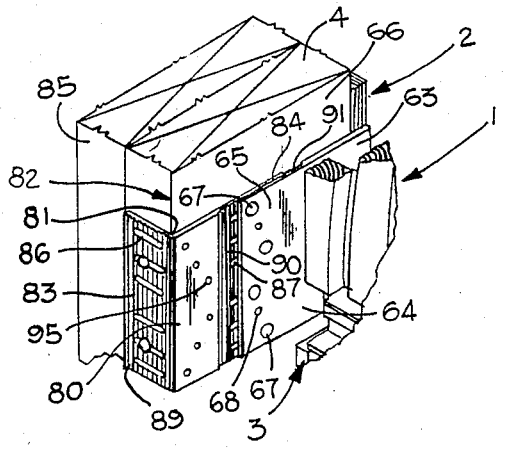
FIG. 5 is a fragmentary perspective view of the left rear end of such window assembly showing the universal nailing plate and corner plate fastened to a studwall comprised of 2×6's.

To facilitate attachment of the end blocks 60 to the wall studs 4, nailing plates 62 may be mounted on the outer ends of the end blocks. As shown in FIGS. 3–5, when one end 63 of each nailing plate 62 is fastened to the respective end blocks, the other end 64 will extend inwardly beyond the interior of the window assembly a sufficient distance to permit the nailing plates to be attached to the respective adjacent stud walls 66 as by driving sinkers 67 or the like through nail holes 68 in such other end. Also, two sets of vertically spaced mounting holes 70 are desirably provided in the end 63 of each nailing plate adjacent the top and bottom edges thereof so that the same identical nailing plate can interchangeably be used at either end of the stiffener 26. The particular set of mounting holes 70 that is used will depend on which end of the stiffener 26 the nailing plate is to be mounted. The nailing plates may be secured to the end blocks by means of screws 71 extending through such mounting holes and into threaded engagement with threaded bores 72 in the outer ends of the end blocks. When properly assembled, the bottom edge of the respective nailing plate is desirably substantially in line with the bottom edge of the end blocks and the front edge 73 is desirably in substantially vertical alignment with the front edge of the wall studs.

The overall length of each nailing plate should be no greater than the width of the smallest size wall stud to which the window assembly is to be attached, for example, 4 inches, so that the nailing plates do not extend beyond either the front or back edges of the wall studs. If the wall studs have a greater width, for example, 6 inches, the nailing plates will simply terminate further away from the back edge of the wall stud.

In addition to the nailing plates 62, corner plates 80 are desirably provided at the ends of the transom stiffener 26 for transferring the shear or torque loads from the window assembly 1 to the wall studs 4. One such corner plate 80 is clearly shown in FIGS. 3–5 as having a right angle bend 81 intermediate the ends thereof for engagement up against a corner 82 of a stud wall 4 with one end 83 or 84 of the corner plate inserted between the other end 64 of the nailing plate 62 and the adjacent side 66 of the mounting stud 4 and the other end 84 or 83 pressed up against the back edge 85 of the mounting stud. Also, a plurality of horizontal slots 86, 87 are desirably provided in both ends 83, 84 of the angle plates 80 in axial alignment with a plurality of nail holes 68 in the nailing plates.

Vertical corrugations 89, 90 are also desirably provided on both ends of the corner plate 80 on the sides facing away from the studs for mating engagement with corresponding vertical corrugations 91 on the other end 64 of the nailing plate 62 on the side facing toward the studs to provide an interlock between the two plates 62, 80 when in the desired assembled relation. The end 84 of each corner plate 80 is also desirably longer than the end 83 so that the shorter end 83 may be placed in underlying engagement with the nailing plate 62 when used with 2×4 wall studs, and the longer end 84 placed in underlying engagment when used with 2×6 wall studs.

The corrugated end 64 of each nailing plate 62 has a lesser thickness than the non-corrugated end 63 so that the non-corrugated end will remain flat up against the adjacent side of the mounting stud when a corrugated end of the corner plate is inserted thereunder. The sinkers or nails 67 that are used to attach the nailing plates 62 to the respective wall studs will also pass through the slots 86 or 87 in the corner plates to secure the corner plates in place along with the nailing plates.

The other ends of the corner plates not underlying the nailing plates may be secured to the back edges of the wall studs using additional sinkers or nails 67 either extending through the slots in such other ends if such other ends are the short ends (see FIG. 5), or through the slots and/or additional holes 95 in such other ends inwardly of the slots if such other ends are the long ends (see FIG. 4).

To install the window assembly 1, care should be taken to make certain that the rough opening 10 in the exterior wall 2 is correctly cut so that it is slightly larger than the frame portion 15 of the window assembly. Next the window assembly should be properly centered in the opening 10 above the window or patio door unit 3 therebeneath and the nail flange 20 securely nailed to the exterior surfaces of the wall studs 4, cross members 11, and diagonal members 12. Then the transom flange 46 should be fastened to the window or patio door unit 3 therebelow and the universal nail plates 62 and corner plates 80 fastened to the wall studs 4 in the manner previously described. Next the window assembly should be sealed all the way around its perimeter and the siding 6 installed. Finally, the wood sash/stop 30 and trim piece 50 may be installed around the interior of the window assembly, followed by the installation of the extension jamb 96 and window and transom casings 97 and 98 all the way around the interior of the window.

From the foregoing, it will now be apparent that the molded window assembly and transom support of the present invention provide a very effective and simple means for transferring the weight of the window assembly to the wall studs while giving the window assembly the appearance of being an integral part of the window or patio door unit therebeneath by keeping the space therebetween to a minimum.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

What is claimed is:

1. In combination, a window assembly and transom support therefor, said window assembly comprising an integrally molded sash, sill and frame formed of plastic, said frame including a generally flat bottom wall, and said transom support comprising a transom stiffener attached to said bottom wall, said sash extending downwardly below said bottom wall to conceal said stiffener, and attachment means for attaching the ends of said stiffener to opposite sides of an opening in an exterior wall for supporting said window assembly above a window or patio door unit or the like in such exterior wall.

2. The combination of claim 1 wherein said attachment means comprises end blocks telescopically received in the ends of said stiffener for taking up any excess space between the ends of said stiffener and the opposite sides of such opening.

3. The combination of claim 2 wherein said attachment means further comprises nailing plates on the outer ends of said end blocks.

4. The combination of claim 3 wherein one end of said nailing plates extends inwardly beyond the interior of said window assembly frame to facilitate attachment of said nailing plates to the adjacent sides of such opening.

5. The combination of claim 4 wherein the other end of said nailing plates has two sets of mounting holes adjacent the top and bottom edges of said nailing plates to permit attachment of said nailing plates to said end blocks at either end of said stiffener.

6. The combination of claim 4 wherein said attachment means further comprises corner plates for transferring torque loads from said window assembly to wall studs on opposite sides of such opening, said corner plates having opposite ends extending at a right angle for engagement up against a corner of such mounting studs with one end of the respective corner plates underlying said one end of said nailing plates and the other end of said corner plates engaging the back edge of the respective wall studs.

7. The combination of claim 6 wherein the side of said one end of said nailing plates facing the adjacent side of the respective wall studs has a thinner cross section than said other end to provide a space for receipt of one end of said corner plates while said other end of said nailing plates is in substantially flat engagement with the adjacent side of the wall studs.

8. The combination of claim 7 wherein said nailing plates and corner plates have opposed contacting surfaces with vertical corrugations therein to provide an interlock between said surfaces.

9. The combination of claim 8 wherein said one end of said nailing plates has a plurality of vertically spaced holes therethrough, and both ends of said corner plates have horizontal slots therethrough in alignment with said holes in said nailing plates for receiving fasteners through said holes and slots for securing said plates to the wall studs.

10. The combination of claim 9 wherein one end of said corner plates is longer than the other end to permit said corner plates to be used to connect said stiffener to the back sides of wall studs having different widths.

11. The combination of claim 2 further comprising limiting means for limiting the extent of outward movement of said end blocks relative to the ends of said stiffeners.

12. The combination of claim 11 wherein said limiting means comprises notches in the outer ends of said end blocks, and stop means on said window assembly extending into said notches.

13. The combination of claim 12 wherein said window assembly includes flange means integrally molded with and extending outwardly from said frame, said flange means having holes therethrough for receiving fasteners for securing said window assembly in such opening in such exterior wall, said stop means comprising a portion of said flange means.

14. The combination of claim 13 wherein said window assembly is a half-round window assembly, and said flange means extends around the upper perimeter of said window frame from one end of said window assembly to the other, a portion of said flange means extending into said notches in said end blocks.

15. The combination of claim 3 wherein said nailing plates include means for limiting the extent of inward movement of said end blocks in the ends of said stiffener.

16. The combination of claim 1 wherein said window assembly includes a glass opening for mounting window glass therein, said glass opening having a substantially flat bottom edge, and fastener means extending through said bottom edge of said window opening into said stiffener for attaching said stiffener to the bottom wall of said window assembly, said window glass being installed in said window opening following such attachment of said stiffener to said window assembly.

17. The combination of claim 1 wherein said stiffener is generally rectangular in cross-section including top and bottom walls and front and back walls, said bottom wall of said stiffener extending inwardly beyond said back wall to provide a nailing flange for attaching said window assembly to such window or patio door unit in the exterior wall below said window assembly.

18. The combination of claim 17 wherein said nailing flange has spaced apart holes along the length thereof for receiving fasteners for securing said window assembly to such window or door unit therebelow.

19. The combination of claim 17 wherein said top wall of said stiffener extends inwardly beyond the interior of said window frame, and hinge means are provided for hingedly connecting an interior sash to said top wall adjacent the interior of said window glass.

20. The combination of claim 19 wherein said hinge means comprises a vertical rib on said top wall inwardly of said frame, and a groove in the bottom edge of said interior sash which fits over said vertical rib.

21. The combination of claim 20 further comprising tape means between said window frame and interior sash having adhesive on both sides for securing said interior sash to said frame around the periphery of said window opening.

22. The combination of claim 20 further comprising a channel in said top wall of said stiffener between the interior of said glass and said vertical rib to collect any moisture that runs down the interior face of said glass.

23. The combination of claim 22 wherein said stiffener is hollow substantially throughout the length thereof, and said front wall extends slightly below the bottom of said sill, and weep holes extend through said top wall of said stiffener in communication with said channel, and additional weep holes extend through the bottom front of said stiffener leading to the exterior of said window assembly below said sill.

24. The combination of claim 23 wherein said bottom wall of said stiffener has a groove extending substantially the full length of said stiffener for receipt of a drip cap/jointing in said groove, said drip cap/jointing extending forwardly from said groove to the exterior of said window assembly below said sill.

25. The combination of claim 17 further comprising a trim piece covering said stiffener back wall and nailing flange, and means for providing a snap connection between said trim piece and back wall to permit removal of said trim piece during the nailing of said nailing flange to the unit therebelow and subsequent reattachment thereto.

26. In combination, a window assembly and transom support therefor, said window assembly comprising a frame including a generally flat bottom wall, and said transom support comprising a transom stiffener attached to said bottom wall, and means for securing the ends of said stiffener to spaced-apart wall studs defining an opening in an exterior wall above a window or patio door unit therebelow, said means comprising end blocks telescopically received in the ends of said stiffener for taking up any excess space between the ends of said stiffener and such wall studs, and nailing plates on the outer ends of said end blocks for attachment to the adjacent sides of the wall studs.

27. The combination of claim 26 wherein said means further comprises corner plates for transferring torque loads from said window assembly to the wall studs, said corner plates having opposite ends extending at a right angle for engagement up against a corner of such wall studs, and means for securing one end of said corner plates to the adjacent side of the wall studs in underlying relation with the respective nailing plates and the other end of said corner plates to the back edge of the respective wall studs.

* * * * *